US005209467A

United States Patent [19]

Schmaling

[11] Patent Number: 5,209,467

[45] Date of Patent: May 11, 1993

[54] SIDE GUIDE ADJUSTMENT PLATE

[75] Inventor: Roderick N. Schmaling, Brookfield, Conn.

[73] Assignee: Pitney Bowes Inc., Stamford, Conn.

[21] Appl. No.: 952,276

[22] Filed: Sep. 28, 1992

[51] Int. Cl.[5] ..... B65H 9/04

[52] U.S. Cl. ..... 271/240; 271/253

[58] Field of Search ..... 271/238, 240, 253-255

[56] References Cited

U.S. PATENT DOCUMENTS 5,098,081 3/1992 DeFigueiredo ..... 271/240

FOREIGN PATENT DOCUMENTS 128147 7/1984 Japan ..... 271/240

*Primary Examiner*—Richard A. Schacher

*Attorney, Agent, or Firm*—Charles R. Malandra, Jr.; Melvin J. Scolnick

[57] ABSTRACT

Apparatus for conveying flat articles of varying width. The apparatus includes: a deck to support the flat articles; a device for moving the flat articles across the deck in a path from an upstream position to a downstream position, the deck having a pair of opposing slots extending perpendicular to the path; an arm below the deck pivotably secured with a center pin to the deck between the deck slots; a pair of links pivotably secured to the arm; a pair of guide plates pivotably secured to the links, each of the guide plates having a slot extending perpendicular to the path and slidingly engaging the center pin; a projecting member extending from each of the guide plates and slidingly engaging the deck slots; and a side guide fixedly secured to each of the guide plates, whereby movement of one of the guide plates in a direction closer or further from the path causes the other of the guide plates to simultaneously move closer or further from the path while the side guides retain a parallel relationship.

6 Claims, 4 Drawing Sheets

18
54
52
22
51
40
36
24
38
16
48
28
12
46
58
20

SIDE GUIDE ADJUSTMENT PLATE

BACKGROUND OF THE INVENTION

The instant invention relates to a sheet feeder and more particularly to the adjustability of the side guides used in a sheet feeder.

Inserting systems in which documents are collected and fed into an envelope are well known. Such systems make substantial use of sheet feeding apparatus in the course of feeding and collecting documents. The inserting systems now used offer more flexibility than their ancestors; in fact, they are prized for their ability to handle a wide variety of sizes of paper. Thus, it is incumbent upon sheet feeders to have sufficient flexibility to adequately process a wide variety of sizes of paper, particularly varying widths of paper.

A sheet feeder can handle a wide variety of paper widths if it has side guides which can be adjusted to handle such variety. Typically, whenever adjustability is built into side guides, what is lost is the rigidity in the side guides which is needed to assure that the side guides remain parallel to the direction of travel of the paper sheets, and parallel to each other. In other words, the flexibility is gained at the expense of rigidity, so that the paper sheets are not necessarily fed across the sheet feeder in the proper alignment.

The instant invention thus overcomes the problems associated with adjustable side guides and provides adjustability to the side guides without a concomitant loss in rigidity of the side guides.

SUMMARY OF THE INVENTION

Accordingly, the instant invention provides apparatus for conveying flat articles of varying width. The apparatus includes: a deck to support the flat articles; means for moving the flat articles across the deck in a path from an upstream position to a downstream position, the deck having a pair of opposing slots extending perpendicular to the path; an arm below said deck pivotably secured with a center pin to the deck between the deck slots; a pair of links pivotably secured to the arm; a pair of guide plates pivotably secured to the links, each of the guide plates having a slot extending perpendicular to the path and slidingly engaging the center pin; a projecting member extending from each of the guide plates and slidingly engaging the deck slots; and a side guide fixedly secured to each of the guide plates, whereby movement of one of the guide plates in a direction closer or further from said path causes the other of said guide plates to simultaneously move closer or further from said path while the side guides retain a parallel relationship.

DETAILED DESCRIPTION OF THE PREFERRED EMBODIMENT

Figure 4:
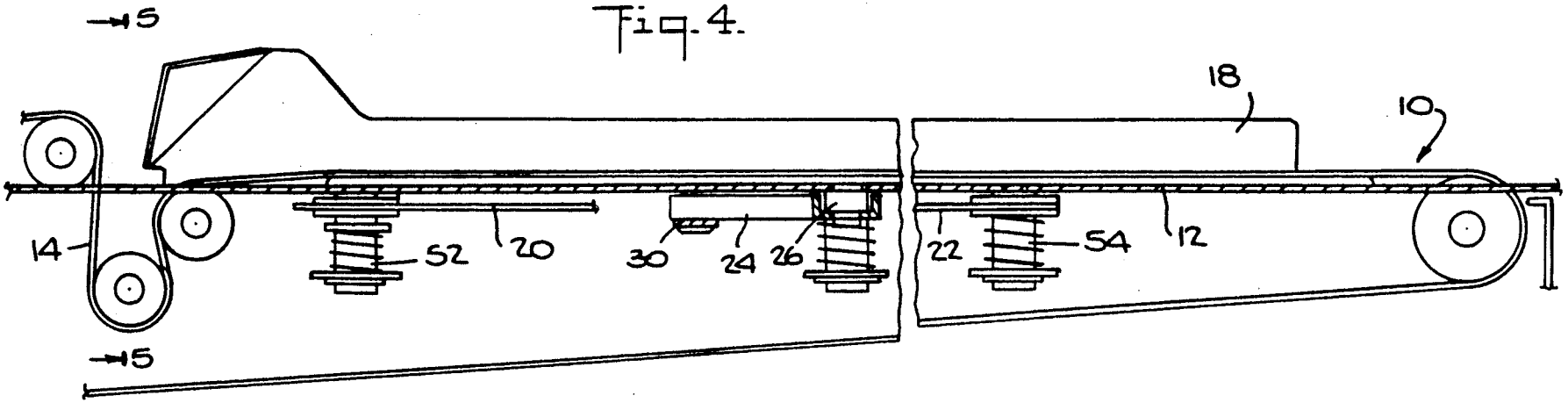
FIG. 4 is a sectional view taken on the plane indicated by the line 4—4 in FIG. 1.
Figure 6:
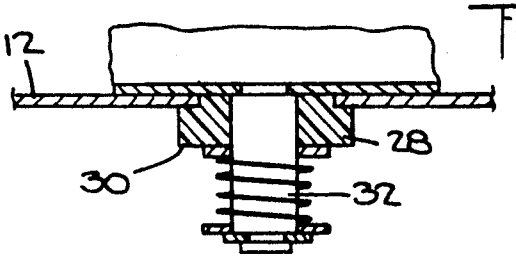
FIG. 6 is an enlarged, vertical, sectional view of the slide seen in FIGS. 1-5.
Figure 5:
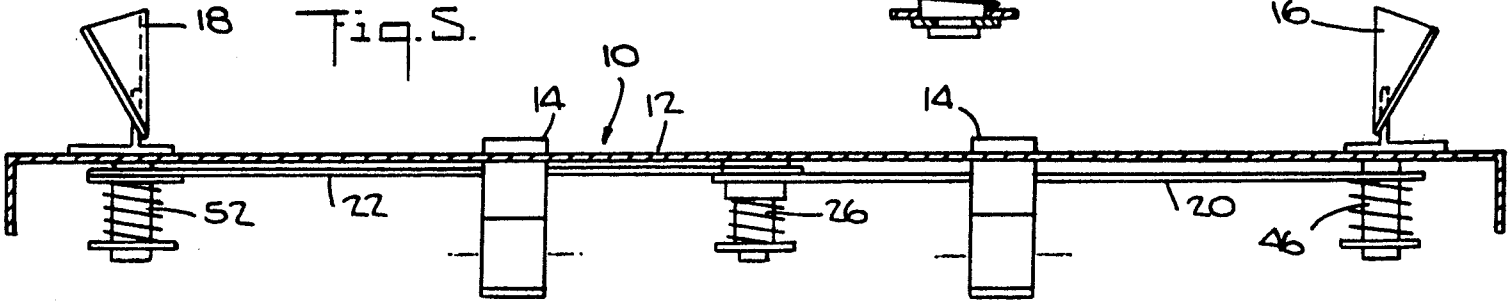
FIG. 5 is a sectional view taken on the plane indicated by the line 5—5 in FIG. 4.

In describing the preferred embodiment of the instant invention, reference is made to the drawings, wherein there is seen in FIGS. 4 and 5 a sheet feeding module 10 having a deck 12 and an endless belt 14 for feeding sheets across the deck 12. The sheet feeder 10 includes a pair of side guides 16 and 18 which can be accurately located and ad3usted by means of a pair of guide plates 20 and 22 situated under the deck 12.

Figure 1:
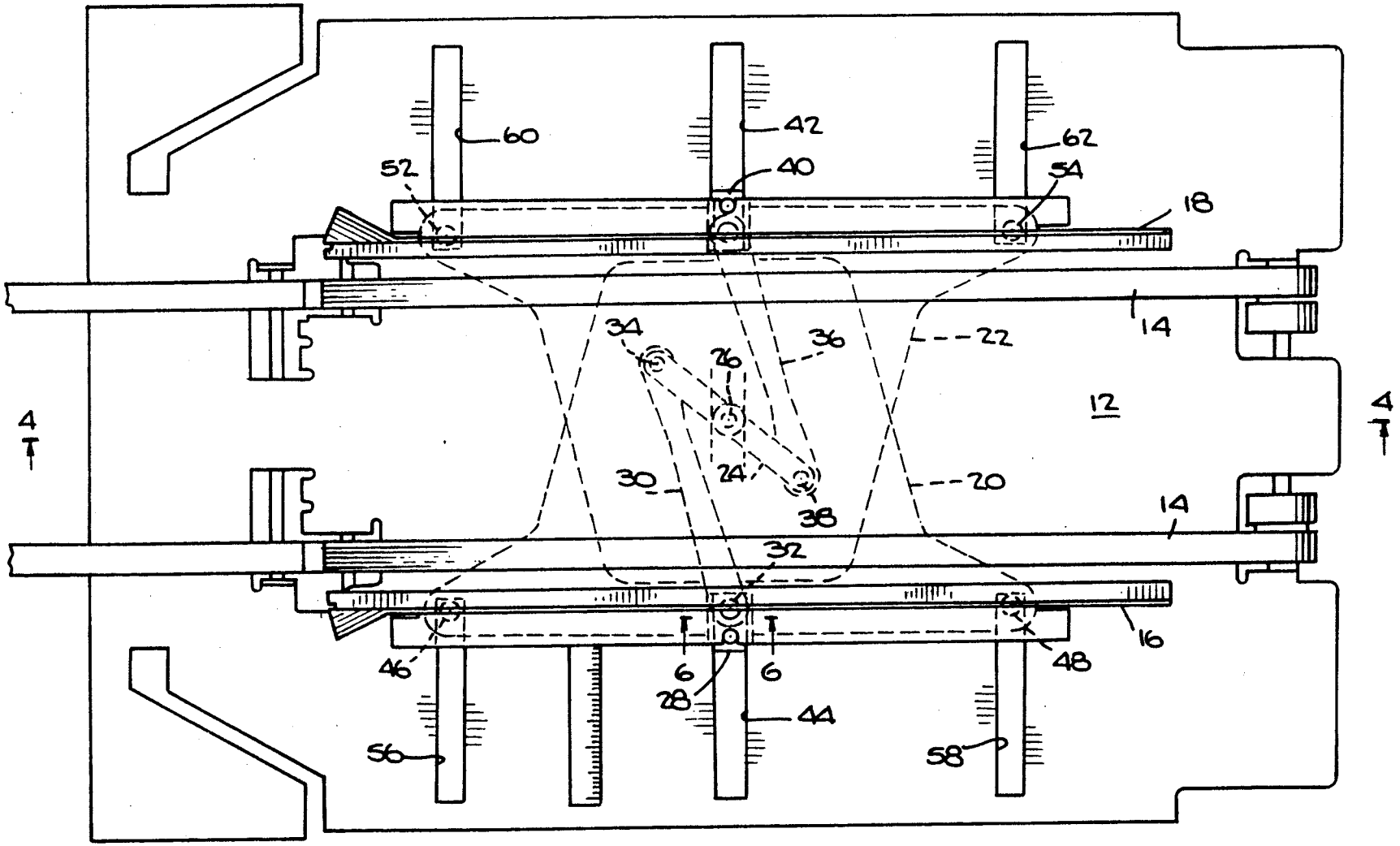
FIG. 1 is a top, plan view of a sheet feeder with adjustable side guides in accordance with the instant invention, and shows the guides in their most closed position.
Figure 2:
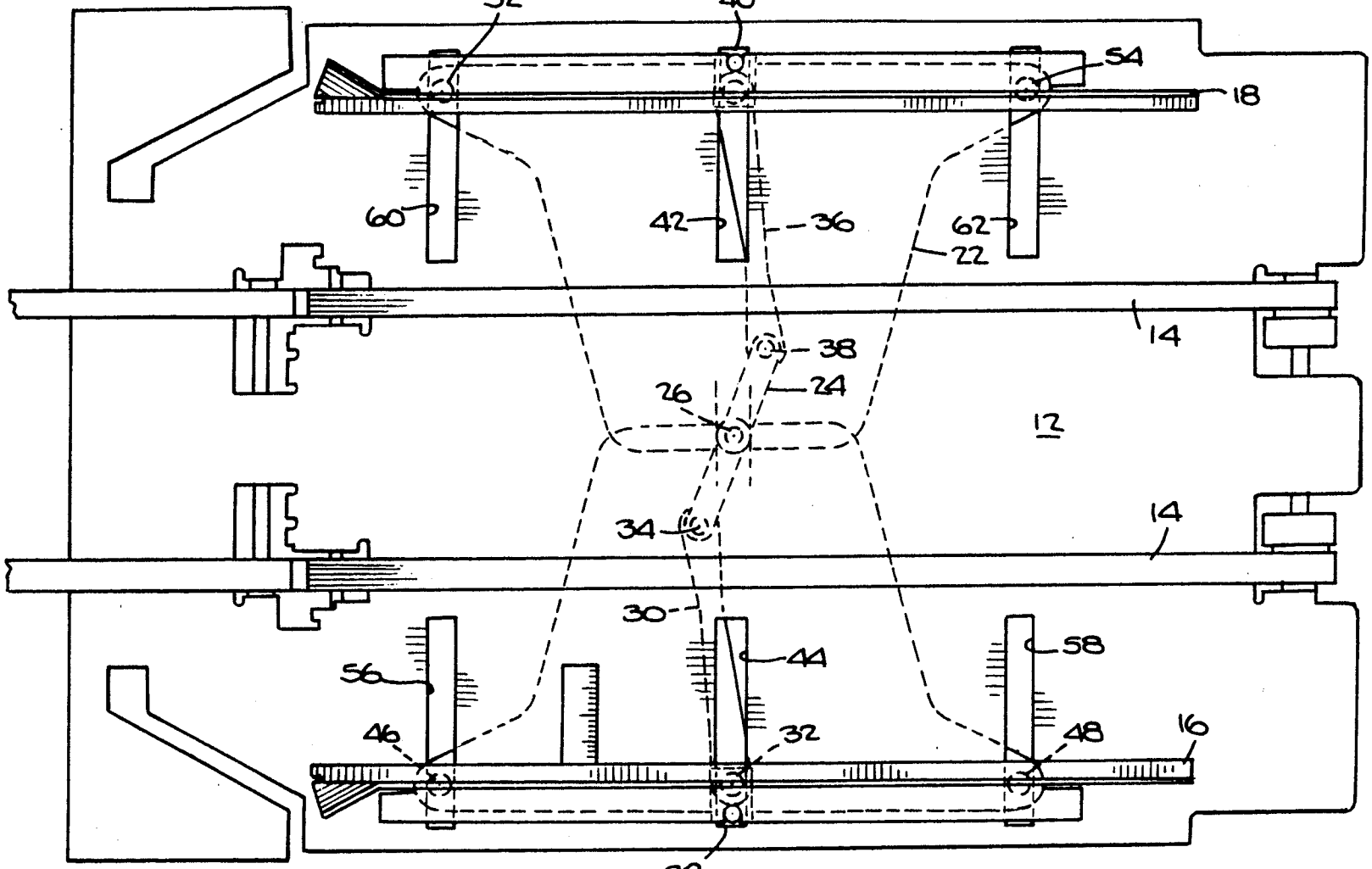
FIG. 2 is similar to FIG. 1 but shows the side guides in their most open position.
Figure 3:
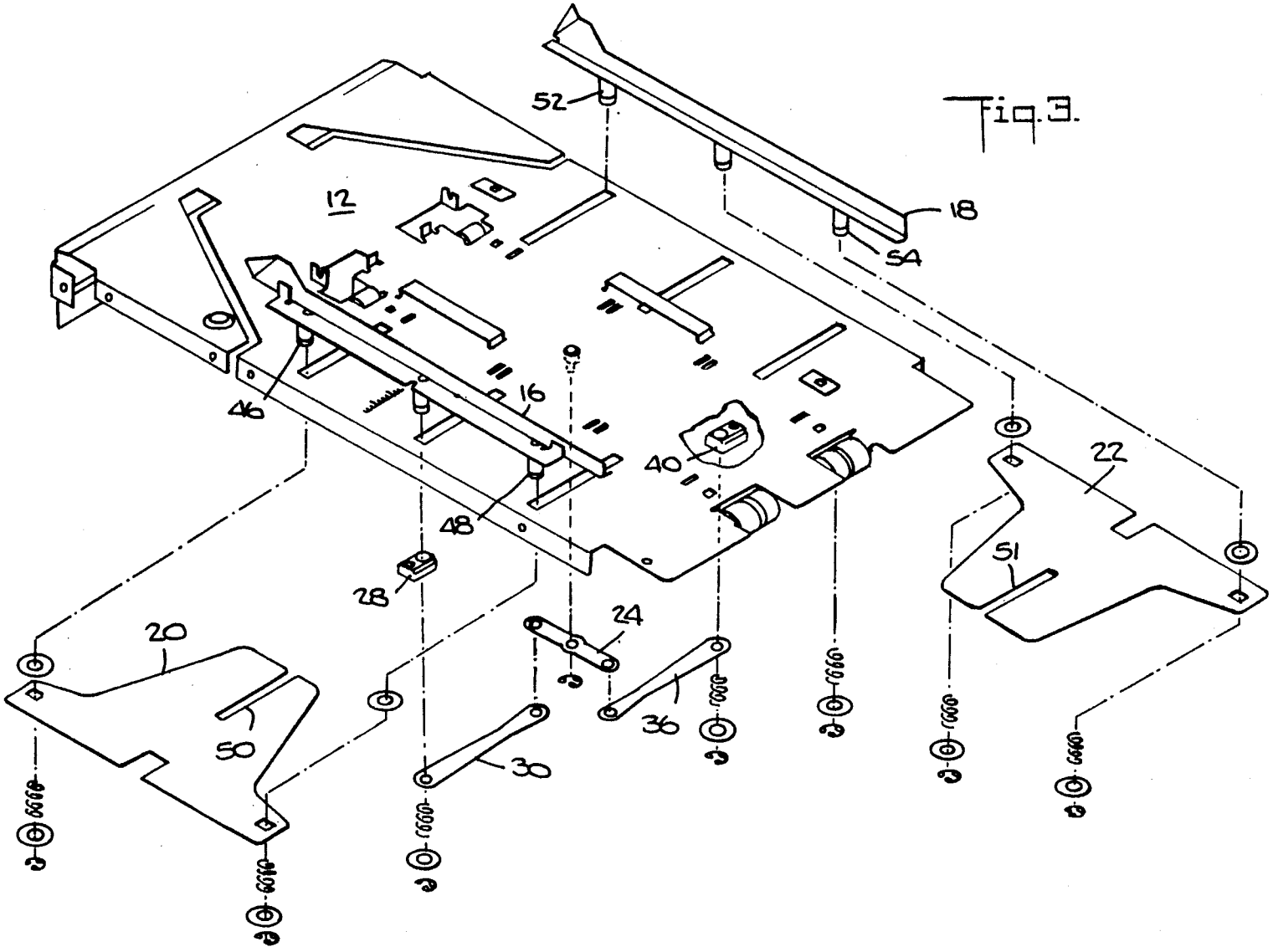
FIG. 3 is an exploded, perspective view of the feeder seen in FIGS. 1 and 2.

Referring now to FIGS. 1 and 2, an arm 24 is pivotably secured to the deck 12 with a center pin 26. The front guide 16 is fixedly secured to a plastic slide 28 which is seated in the guide plate 20. The slide 28 is pivotably secured to a link 30 with a pin 32. The link 30 is pivotably secured to the arm 24 with a pin 34. The other end of the arm 24 is pivotably secured to a link 36 with a pin 38. The other end of the link 36 is pivotably secured to a plastic slide 40 which is seated in the guide plate 22. The slide 40 is secured to the rear, side guide 18 which slides in a slot 42 in the deck 12. The other slide 28 slides in a slot 44 in the deck 12. The guide plate 20 is secured to the front side guide 16 with pins 46 and 48. The guide plate 22 is secured to the rear side guide 18 with pins 52 and 54. The plate 20 has a slot 50 and the plate 22 has a slot 51 (see FIG. 3) which engage on the pin 26. The plate 20 rides on top of the plate 22 which is identical to the plate 20.

The guide plate 20, and hence the side guide 16, are prevented from turning in the course of the guide 16 being adjusted by means of the slide 18 riding in the slot 44 and the slot 50 slidingly engaging the pin 26. Similarly, the guide plate 22, and hence the side guide 18, are prevented from turning in the course of the guide 18 being adjusted by means of the slide 40 riding in the slot 42 and the slot 51 slidingly engaging the pin 26.

The slots 56, 58, 60 and 62 provide a clearance for the pins 46, 48, 52 and 54 respectively.

In FIG. 1, the side guides 16 and 18 are set for the minimum width of sheets or inserts. FIG. 2 shows the side guides 16 and 18 set for the maximum width sheet or insert. To make the desired adjustment from a narrower width to a greater width in the side guides 16 and 18, the operator merely pulls the front side guide 16 toward the front of the module 10. This pulling causes the slide 28 to slide in the slot 44 and the link 30 is pulled with the slide 28. This action in turn causes the arm 24 to rotate around the pin 26. The other end of the arm 24 via the pin 38 pushes the link 36 back, causing the slide 40 to slide back in the slot 42. The rear side guide 18, secured to the slide 40, is likewise moved back. Thus, it can be seen that the movement of the side guides 16 and 18 is synchronized. The plates 20 and 22, by means of their respective slots 50 and 51, maintain the side guides 16 and 18 parallel with each other.

While the invention has been described in conjunction with specific embodiments thereof, many alternative, modifications and variations will be apparent to those skilled in the art. It is intended to embrace all such alternatives, modifications and variations that follow within the spirit and scope of the appended claims.

What is claimed is:

1. Apparatus for conveying flat articles of varying width, comprising:

a deck to support said flat articles;

means for moving said flat articles across said deck in a path from an upstream position to a downstream position, said deck having a pair of opposing slots extending perpendicular to said path;

an arm below said deck pivotably secured with a center pin to said deck between said deck slots;

a pair of links pivotably secured to said arm;

a pair of guide plates pivotably secured to said links, each of said guide plates having a slot extending perpendicular to said path and slidingly engaging said center pin;

a projecting member extending from each of said guide plates and slidingly engaging said deck slots; and a side guide fixedly secured to each of said guide plates, whereby movement of one of said guide plates in a direction closer or further from said path causes the other of said guide plates to move simultaneously closer or further from said path while said guides retain a parallel relationship.

2. The apparatus of claim 1, wherein said projecting member comprises a slide fixedly secured to said guide plate and pivotably secured to one of said links.

3. The apparatus of claim 2, wherein side slide comprises plastic.

4. The apparatus of claim 3, wherein one of said plates rides above the other of said plates.

5. The apparatus of claim 4, wherein said flat articles comprise sheets of paper.

6. The apparatus of claim 5, wherein said moving means comprises an endless belt.

* * * * *